United States Patent [19]

Eder et al.

[11] Patent Number: 4,713,957

[45] Date of Patent: Dec. 22, 1987

[54] REVERSE BEND ATTACHMENT FOR A SHEET METAL BRAKE

[76] Inventors: Ernest J. Eder, 16810-27th Ave. SW.; Laverne D. Goodwin, 16901-27th Ave. SW., both of, Seattle, Wash. 98166

[21] Appl. No.: 895,788

[22] Filed: Aug. 12, 1986

[51] Int. Cl.[4] ..... B21D 5/04

[52] U.S. Cl. ..... 72/319; 72/323; 72/293

[58] Field of Search ..... 72/319, 320, 322, 323, 72/387, 388, 310, 293

[56] References Cited

U.S. PATENT DOCUMENTS

| | | | |
|---|---|---|---|
| 362,749 | 5/1887 | Keene . | |
| 816,917 | 4/1906 | Keene . | |
| 941,783 | 11/1909 | Keene . | |
| 1,721,698 | 7/1929 | Krueger . | |
| 2,557,346 | 6/1948 | Green . | |
| 2,699,812 | 1/1955 | McCormack et al. . | |
| 2,767,762 | 10/1956 | Peterson . | |
| 3,192,759 | 7/1965 | Pelton et al. | 72/319 |
| 3,359,772 | 12/1967 | Fillip | 72/319 |
| 3,568,300 | 3/1971 | Zidell | 72/319 |
| 3,913,370 | 10/1975 | Break | 72/322 |
| 3,914,974 | 10/1975 | DeVore | 72/319 |
| 3,948,074 | 4/1976 | Stalzer | 72/312 |
| 4,351,176 | 9/1982 | Anderson | 72/322 |
| 4,510,785 | 4/1985 | Triouleyre et al. | 72/323 |

*Primary Examiner*—Daniel C. Crane

*Attorney, Agent, or Firm*—Delbert J. Barnard

[57] ABSTRACT

End mounts (92, 94) of an attachment are connected to bed (14) and bending leaf (44) portions of a shet metal brake (10). A right angle outer corner (102) is formed where an upper edge surface 46 of the bending leaf (44) intersects a side surface (48) of the bending leaf (44). A bending member (90) extends between the end mounts (92, 94) and is mounted for pivotal movement between a start position and a forming position. The bending member (90) carries force applying surface means (38) which rests on an overhanging portion of a sheet metal member (42). The operator swings the bending member (90) downwardly and as the bending member (90) so moves, the force applying surface (38) bends the sheet metal member (42) down about the right angle corner (102). The end mounts (86, 88) are formed to include arcuate slots (104, 106) having geometric centers which coincide with the bending corner (102). End members (92, 94) at the ends of the bending member (90) carry roller elements (108, 110, 112, 114) which fit into the slots (104, 106) and togehter with the slots (104, 106) mount the bending member (90) for pivotal movement about an axis coinciding with the bending corner (102).

15 Claims, 12 Drawing Figures

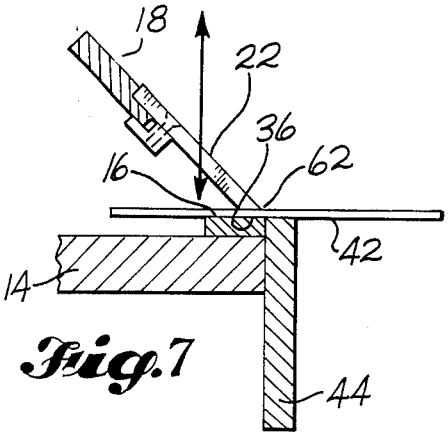
Fig. 7
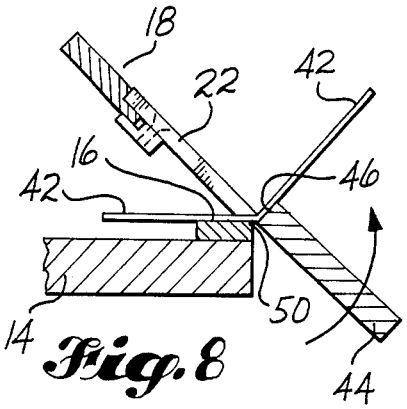
Fig. 8
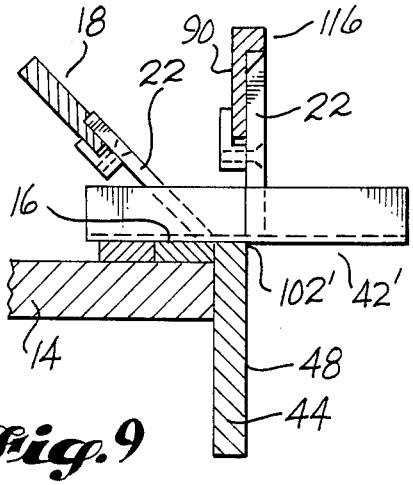
Fig. 9
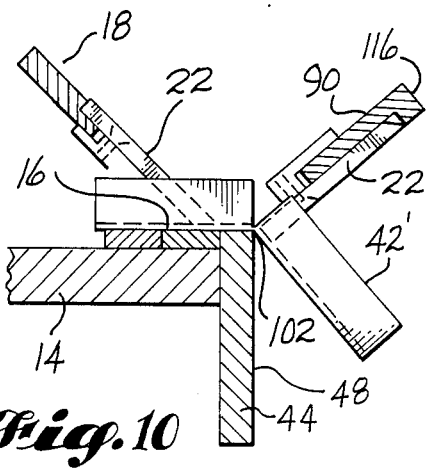
Fig. 10
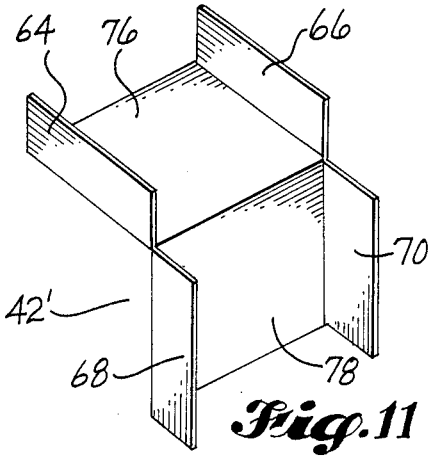
Fig. 11
Fig. 12
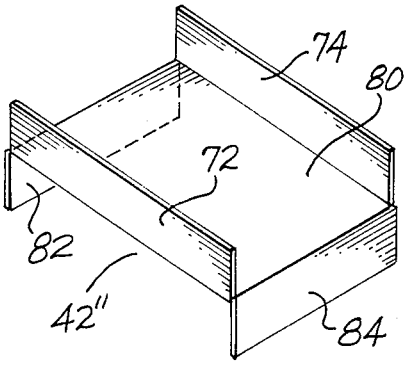

REVERSE BEND ATTACHMENT FOR A SHEET METAL BRAKE

DESCRIPTION

1. Technical Field

The present invention relates to sheet metal brakes. More particularly, it relates to the provision of an attachment that can be applied a conventional sheet metal box and pan brake, to make such brake usable for putting a reverse bend in a sheet metal member.

2. Background Art

A conventional sheet metal box and pan brake is hereinafter described as a part of the description of the best mode of the invention.

Known sheet metal brakes, and known attachments for sheet metal brakes, which can be found in the patent literature, are disclosed by the following U.S. Pat. Nos. 362,749, granted May 10, 1887, to George C. Keene; 816,917, granted Apr. 3, 1906, to George C. Keene; 941,783, granted Nov. 30, 1909, to George C. Keene; 1,721,698, granted July 23, 1926, to John Kruger; 2,557,346, granted June 19, 1951, to Lee B. Green; 2,699,812, granted Jan. 18, 1955, to J. L. White and J. C. McCormick; 2,767,762, granted Oct. 23, 1956, to George H. Peterson; 3,192,759, granted July 6, 1965, to Clyde I. Pelton and Eduard P. Schneider; 3,913,370, granted Oct. 21, 1975, to Douglas G. Break; 3,948,074, granted Apr, 6, 1976, to Leo Henry Stalzer; 4,351,176, granted Sept. 28, 1982, Carl Anderson; and 4,510,785, granted Apr. 16, 1985, to Jean Triouleye, Jean Rousselin, Patrick Shmidt and Philippe Gondry.

These patents should be carefully studied for the purpose of putting the present invention into proper perspective relative to the prior art.

DISCLOSURE OF THE INVENTION

It is a principal object of the present invention to provide an attchment for a conventional sheet metal box and pan brake which is very simple in construction, involves a few parts, and can easily be assembled to, and disassembled from the brake.

In accordance with the invention, the attachment comprises a pair of spaced apart end mounts connectable to the brake. Each end mount has a first portion which extends over a support bed portion of the brake, and a second portion which extends downwardly from the first portion outwardly adjacent the outer side of a bending leaf, when the bending leaf is in an inactive position. A bending member extends longitudinally between the two end mounts. Means are provided for pivotally connecting the bending member to the end mounts, for pivotal movement between a start position and a forming position. the bending member includes a force applying surface means. When the bending member is in a start position and a sheet metal member is clamped between the bed and the clamp means of the brake, and extends horizontally outwardly from the outer side of the bending leaf, the surface means makes contact with an upper surface portion of the sheet metal member. Contact is made at a location immediately outwardly of a right angle corner formed by an upper edge surface and the outer side surface of the bending leaf.

The means for pivotally connecting the bending member to the end mounts comprises a pair of arcuate slots, one at each end mount. The slots have centers which substantially coincide with the right angle corner formed where the upper edge surface of the bending leaf meets the outer side surface of the bending leaf. It further includes bearing means carried by the bending member. The bearing means extend into the slots and mount the bearing member for pivotal movement between its start and bending positions about an axis coinciding with the right angle corner formed where the upper edge surface of the bending leaf meets the outer side surface of the bending leaf.

Other more detailed features of the invention are described below as a part of the description of the best mode of the invention.

BRIEF DESCRIPTION OF THE DRAWINGS

Like reference numerals are used to designate like parts throughout the several views of the drawing, and;

FIGS. 7 and 8 are sequence of use diagrams, showing the manner in which the sheet metal brake is normally employed for bending a sheet metal member, FIG. 7 showing the bending leaf in its down position, and the sheet metal member clamped between the clamp means and the support, and FIG. 8 showing the bending leaf in the process of being swung upwardly, to apply a bending force on an overhanging portion of the sheet metal member.

FIGS. 9 and 10 are views like FIGS. 7 and 8, but showing the manner of use of the attachment, FIG. 9 showing the sheet metal member being clamped between the clamp means and the support, as before, and showing the bending member in its start position, and FIG. 10 showing the bending member in the process of being swung downwardly, for the purpose of applying a bending force on the sheet metal member;

FIG. 11 is an isometric view of the sheet metal member shown in FIGS. 9 and 10, after the attachment has been used to form a reverse bend in such sheet metal member; and FIG. 12 is an isometric view showing a second sheet metal member which has been formed by the breaker and the attachment, and which includes a pair of sidewalls extending at right angles from a base wall, in a first direction, and a pair of end walls extending at right angles to the base member, in the opposite direction.

BEST MODE FOR CARRYING OUT THE INVENTION

FIGS. 1–4, 9 and 10 show an embodiment of the invention mounted on a conventional box and pan brake 10. By way of nonlimitive example, the brake may be a Connecticut Bending Brake, Model No. U416, manufactured by W. Whitney Stueck, Inc., of Essex, Connecticut and Pleasant Grove, Utah.

Figure 3:
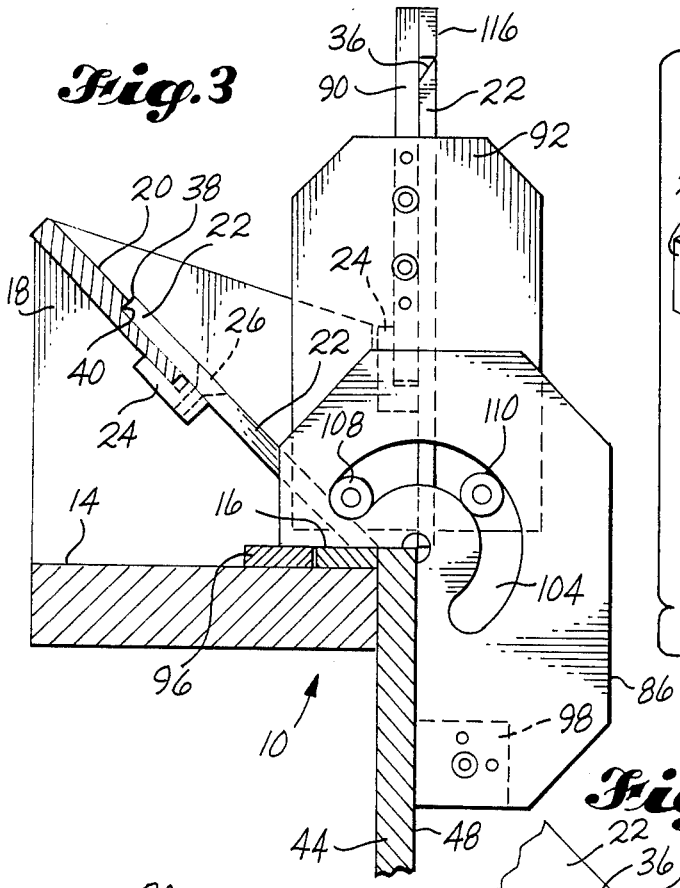
FIG. 3 is an end elevational view, looking toward one end of the attachment, showing the bending member in its start position.
Figure 5:
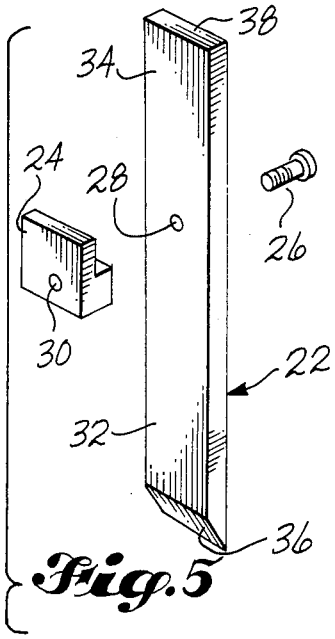
FIG. 5 is an isometric view of a clamp tooth, showing a mounting clamp portion of the tooth spaced from the tooth proper.
Figure 4:
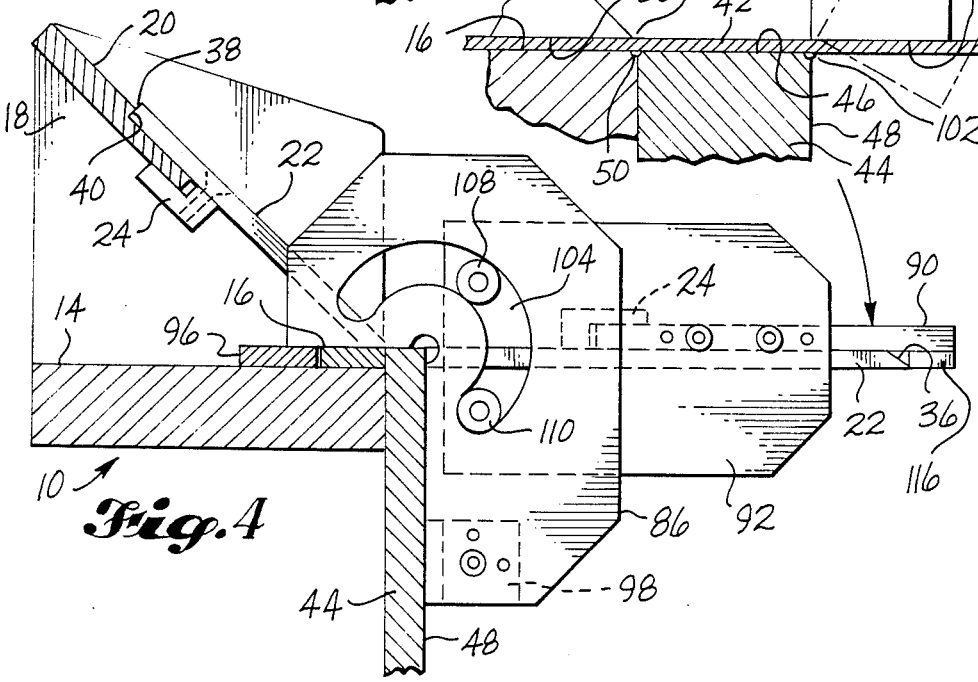
FIG. 4 is a view like FIG. 3, but showing the bending member in its forming position.

Brake 10 comprises a frame 12 which includes a bed 14. Bed 14 includes a support 16 for a sheet metal member. The brake 10 also includes a clamp means 18 which is movable up and down. The clamp means 18 comprises a clamp frame 20 and a plurality of clamp teeth 22 which are secured to the clamp frame 20. As shown in FIG. 5, each tooth 22 comprises a clamp member 24 and a connecting screw fastener 26. The screw fastener 26 extends through an opening 28 in the tooth 22 and threads into an internally threaded opening 30 in the member 24. Tooth 22 includes a first end portion 32 which extends in one direction from the opening 28 and a second end portion 34 which extends in the opposite direction from opening 28. End portion 32 has a beveled end 36 and end portion 34 has a squared end 38. As shown by FIGS. 3 and 4, the teeth 22 are normally positioned on the clamp frame 20, with their squared ends 38 against a shoulder surface 40. The clamp member 24 is installed and the screw fastener 26 is tightened to securely clamp the tooth 22 on the clamp frame 20.

The clamp frame 20 extends at an angle to the bed 14. That is why the teeth 22 are provided with beveled ends 36. As shown by FIGS. 3, 4 and 6–10, when the clamp means 18 is lowered, the beveled surface 36 contact a sheet metal member 42. The sheet metal member 42 is supported on the support 16. This surface 46 presses down tightly against sheet metal member 42, so that the member 42 is gripped by the tooth surface 36 and bed 16.

Figure 6:
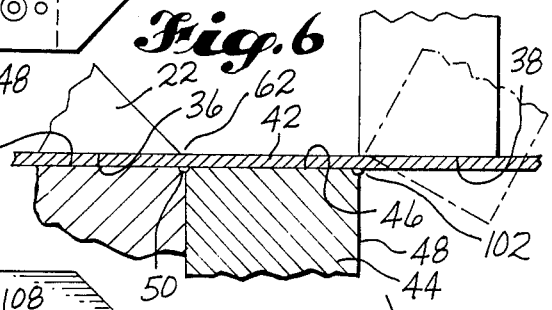
FIG. 6 is an enlarged scale fragmentary view in the region of the right angle forming corner on the bending leaf, the force applying surface of the bending member, and the pivotal axis established by the arcuate slots and bearings which pivotally connect the bending member to the end mounts.

Brake 10 includes a bending leaf 44 which is pivotally connected to the frame 12. Bending leaf 44 has a down position, shown in FIGS. 1–4, 7, 9 and 10. When member 44 is in its down position, it extends generally vertically. It has an edge surface 46 which is substantially coplanar with the support 16 (FIG. 6). Edge surface 46 forms a right angle outer corner with the outer surface 48 of bending leaf 44. As clearly shown by FIG. 1, this corner extends the full length of the bending leaf 44.

Figures 1, 2:
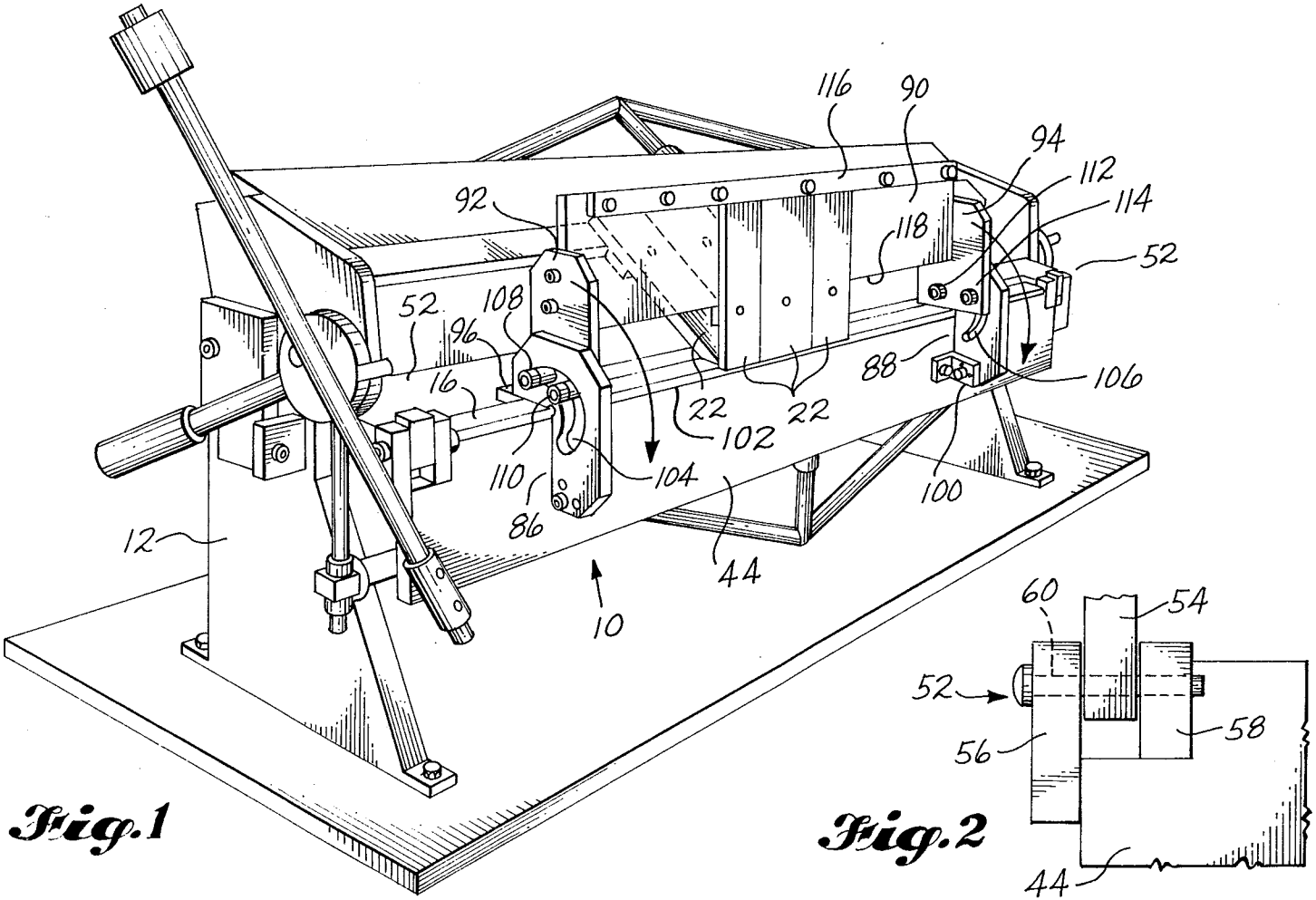
FIG. 1 is an isometric view of an attachment embodying the present invention, attached to a standard sheet metal brake.
FIG. 2 is an enlarged scale fragmentary view of a pivot pin connection at an end of the bending leaf.

Bending leaf 44 pivots about an axis 50 (FIGS. 6–8). As shown by FIGS. 1 and 2, the bending leaf 44 is connected to the frame 12 by mean of a pair of knuckle hinges 52, one at each end of the bending leaf 44. Each knuckle hinge 52 comprises a hinge member 54 that is attached to the frame 12 and a pair of hinge members 56, 58 which are attached to the bending leaf 44. Member 54 is located between members 56, 58. members 54, 56, 58 include aligned openings which receive a pivot pin 60.

Referring to FIGS. 7 and 8, a flat sheet metal member 42 is shown positioned on the support 16 of bed 14. The clamp means 18 is shown in a down position, with the beveled surface 36 in contact with the sheet metal 42, generally above the support 16. Bending leaf 44 is in its down position. Then, to form a bend, the bending leaf 44 is swung upwardly, as shown by FIG. 8. The portion of the sheet metal member 42 which is clamped between clamping means 18 and the support 16 is fixed against any movement. The overhanging portion of the sheet metal member 42 is contacted by the edge surface 46. Thus, as bending leaf 44 is moved upwardly, the sheet metal member 42 is bent about the forming edge 62.

The type of sheet metal brake which has been described can form a box by bending four sides upwardly relative to a bottom. This is made possible by the use of the clamp teeth 22. A sufficient vertical space exists below the clamp frame 18 to accommodate upwardly turned portions of the sheet metal member 42. This is shown in FIGS. 9 and 10. The teeth 22 are chosen in width and number to provide an elongated edge 62 that is about the same length as the right angle corner that is to be formed. A problem with this type of brake is that it cannot be used to bend sheet metal in two directions. For example, in FIG. 11, the members 64, 66 are bent upwardly at a right angle to a base portion 76. The members 68, 70 are also bent at a right angle to a base member 78. FIG. 11 shows base member 78 bent at a right angle to base member 76 in a direction that is opposite to the direction of bending of the side members 64, 66, 68, 70. It is not possible to make this type of a bend on the standard brake 10. FIG. 12 shows side members 72, 74 extending upwardly at right angles to a base member 80. End members 82, 84 are shown bent at right angles to the base member 80, in a direction opposite the directional end of the sidewalls 72, 74. This shape 42′ could not be formed with the standard brake 10. Both of the shapes 42′, 42″, can be formed by use of the attchment of this invention, in conjunction with the braker 10.

As shown in FIG. 1, the attachment of the present invention is positioned on the braker 10, generally over the support 16 and outwardly from the outer surface 48 of bending leaf 44. It is of considerable length but is shorter than the distance between the hinge assemblies 52.

In preferred form, the attachment comprises a pair of end mounts 86, 88, and a bending member 90. Bending member 90 includes end members 92, 94. As best shown by FIG. 3, end mount 86 includes a first upper portion which extends over the support 16 of bed 14 and a second portion which is disposed outwardly of the surface 48 of bending leaf 44. End mount 88 is identical in construction and so it is not illustrated. An elongated metal bar 96 may extend between the end mounts 86, 88. Bar 96 is substantially equal in thickness to a bar-like member which provides the support 16 (FIGS. 3 and 4). The end mounts 86, 88 are fastened to the opposite ends of the bar 96. Bar 96 rests on the bed 14 and extends substantially parallel to the member which provides the support 16. Member 96 may be removably secured to the bed 14, such as by use of screw fasteners (not shown).

As shown by FIGS. 1, 3 and 4, angle iron members 98, 100 may be interconnected between bending leaf 44 and the end mounts 86, 88. One leg of each angle member 98, 100 may be screwed to the bending leaf 44. The other leg may be screwed to its end mount 86, 88.

In order to form a reverse bend it is necessary to shift the bending corner from location 50 (FIG. 6) to location 102 (FIG. 6). A problem with doing this is that it is physically impossible to use pivot pins which have their axes coinciding with the bending edge 102. However, bending edge 102 must become the center of bending movement of the sheet metal member 42.

In accordance with the present invention, the end mounts 86, 88 are provided with arcuate slots 104, 106 which have geometric centers coinciding with the bending corner 102. End members 92 each carry a pair of spaced apart bearings. The bearings for end member 92 are shown by FIGS. 1 and 4 and are designated 108, 110. The inner ends of the bearing members 112, 114, carried by end member 94, are shown by FIG. 1. These bearing members 108, 110, 112, 114 may comprise rollers of a diameter substantially equal to the width of the arcuate slot 104, 106. These rollers turn on pin axles which are secured to the end members 92, 94.

As illustrated, the end members 92, 94 may be screw connected to the ends of the bending member 90.

Bending member 90 may include a locator bar 116 which extends along a substantial portion of the bending member 90. It extends along the side of the bending member 90 that is opposite the clamp means 18. It is located close to the outer edge of the member 90. Member 90 includes an inner edge 118 which is spaced from the bending leaf 44.

Bending member 90 includes an inner edge 118 which is also spaced from the bending leaf 44. It also includes removable teeth 22. In preferred form, the attachment is constructed so that the same teeth 22 that are used as a part of the clamp means 18 can be used as a part of the bending member 90. The only difference is that the teeth 22 are turned end-for-end, so that the squared ends 38 are exposed and the beveled opposite ends 36 are against the locator bar 116. As before, the clamp members 24 and the screw fasteners 26 are used to clamp the teeth 22 onto the main body of bending member 90. This arrangement is shown in FIGS. 1, 9 and 10.

When the bending member 90 is vertically oriented, in its start position, the squared ends 38 of the teeth 22 are positioned generally on the upper surface of the sheet metal member 42. This is best shown in FIG. 6 of the drawing. As earlier described, the slots 104, 106 and the bearings 108, 110, 112, 114 mount the bending member 90, including the teeth 22, for movement between the start position (FIGS. 1, 3 and 9) and a forming position (FIG. 4). Pivotal movement is about the corner line 102.

Referring to FIGS. 9 and 10, the clamping means 18 is used as before, for clamping the base wall (e.g. 76) of the member (e.g. 42') in position relative to the support 16. As before, the teeth 22 which are a part of the clamping means 18 provide a way of accommodating the previously bent sidewalls (e.g. 64, 66). The teeth 22 that are a part of the bending member 90 perform this same function (FIGS. 9 and 10). The sheet metal member (e.g. 42') is positioned in the brake 10, with the bending member 90 in its start position. Then, the reverse bend is accomplished by the operator by merely swinging the bending member 90 downwardly, by hand, about the axis 102. This moves surface 28 which is in contact with the sheet metal member 42, and causes a bending of the sheet metal member 42, about the right angle corner 102. Bending continues until bending member 90 is perpendicular to bending leaf 44 and the base wall (e.g. 78) is against surface 48 (FIG. 4).

When not needed, the attachment can be stored to one side of the brake 10. When needed, it can be easily and quickly picked-up and installed onto the brake 10, in the manner described. The attachment requires no alteration of the basic brake structure 10, other than the formation of tapped openings for receiving fastener screws. It advantageously provides a second use for the teeth 22. Each braker 10 comes with enough teeth 22 so that some can be used as a part of the clamp means 18 and some others can be used as a part of the bending member 90.

Various modifications in construction details, including the shapes of members, and the manner of securing the attachment to the brake 10, etc., can be made without deviating from the basic teachings of the invention. In accordance with established patent law, the embodiment that is illustrated is presented for example purposes only. The invention is not to be limited by the details of the disclosed embodiments, but only by a proper legal interpretation of the claims, including a use of the doctrine of equivalents.

What is claimed is:

1. For use with a sheet metal box and pan brake of a type comprising a bed including a sheet metal support having an elongated edge; clamp means including forming edge means which is positioned substantially vertically above the support edge when the clamp means is functioning to clamp a sheet metal member against said support; and a bending leaf which is pivotally attached to said bed, for pivotal movement between a down position and an up position, said bending leaf having an edge surface which is generally coplanar with the support surface of the bed when the bending leaf is in its down position, said bending leaf having an outer side and a right angle outer corner formed where said edge surface intersects the outer side of the bending leaf, a reverse bend making attachment comprising:

a pair of spaced apart end mounts detachably connectable to said brake, each said end mount having a first position for extending over the support of the bed and a second portion for extending downwardly from the first portion outwardly adjacent the outer side of the bending leaf;

a bending member extending longitudinally between said end mounts;

means pivotally connecting the bending member to said end mounts, for pivotal movement between a start position and a forming position;

said bending member having a force applying surface means, wherein when the bending member is in its start position, and a sheet metal member is clamped between the bed and the clamp means of the brake, and extends horizontally outwardly from the outer side of the bending leaf, said surface means makes contact with an upper surface portion of the sheet metal member at a location immediately outwardly of said right angle corner on the bending leaf; and said means for pivotally connecting comprising a pair of arcuate slots, one in each end mount, having centers substantially coinciding with said right angle corner, and bearing means carried by the bending member and extending into said slots, said bearing means mounting the bending member for pivotal movement between its start and bending positions about an axis coinciding with said right angle corner on the bending leaf.

2. A reverse bend making attachment according to claim 1, wherein the bending member comprises a frame which is spaced radially outwardly from said right angle corner on the bending leaf, and at least one tooth secured to said frame and extending therefrom generally towards the said right angle corner on the bending leaf, said force applying surface means comprising an end surface on said tooth.

3. A reverse bend making attachment according to claim 1, comprising an elongated bar member extending between said end mounts and at its ends being connected to said end mounts, said bar member being positionable on the bed of the sheet metal brake.

4. A reverse bend making attachment according to claim 1, comprising connection means secured to said end mounts, each said connection means including a member which projects laterally from its end mount contiguous the outer side of the bending leaf, and screw fastener means extendible through said member and connectable to the bending leaf, for connecting such member and the end mount of which it is a part of the bending leaf.

5. A reverse bend making attachment according to claim 4, comprising an elongated bar member extending between said end mounts and at its ends being connected to said end mounts, said bar member being positionable on the bed of the sheet metal brake.

6. In combination;

a sheet metal brake comprising;

a bed including a sheet metal support having an elongated edge;

clamp means including forming edge means which is positioned substantially vertically above the support edge when the clamp means is functioning to clamp a sheet metal member against said support; and a bending leaf which is pivotally attached to said bed, for pivotal movement between a down position and an up position, said bending leaf having an edge surface which is generally coplanar with the support surface of the bed when the bending leaf is in its down position, said bending leaf having an outer side and a right angle outer corner formed where said edge surface contacts the outer side of the bending leaf; and a reverse bend making attachment comprising:

a pair of spaced apart end mounts detachably connected to said brake, each said end mount having a first portion which extends over the support of the bed and a second portion which extends downwardly from the first portion outwardly adjacent the outer side of the bending leaf;

a bending member extending longitudinally between said end mounts;

means pivotally connecting the bending member to said end mounts, for pivotal movement between a start position and a forming position;

said bending member having a force applying surface means, wherein when the bending member is in its start position, and a sheet metal member is clamped between the bed and the clamp means of the brake, and extends horizontally outwardly from the outer side of the bending leaf, said surface means makes contact with an upper surface portion of the sheet metal member at a location immediately outwardly of said right angle corner on the bending leaf; and said means for pivotally connecting comprising a pair of arcuate slots, one in each end mount, having centers substantially coinciding with said right angle corner, and bearing means carried by the bending member and extending into said slots, said bearing means mounting the bending member for pivotal movement between its start and bending positions about an axis coinciding with said right angle corner on the bending leaf.

7. The combination of claim 6, wherein the bending member comprises a frame having an inner edge which is spaced radially outwardly from said right angle corner on the bending leaf, and at least one tooth secured to said frame and extending therefrom generally towards the said right angle corner on the bending leaf, said force applying surface means comprising an end surface on said tooth.

8. The combination of claim 6, comprising an elongated bar member extending between said end mounts and at its ends being connected to said end mounts, said bar member being positionable on the bed of the sheet metal brake.

9. The combination of claim 6, comprising connection means secured to said end mounts, each said connection means including a member which projects laterally from its end mount contiguous the ouer side of the bending leaf, and screw fastener means extendible through said member and connectable to the bending leaf, for connecting such member and the end mount of which it is a part to the bending leaf.

10. The combination of claim 9, comprising an elongated bar member extending between said end mounts and at its end being connected to said end mounts, said bar member being positionable on the bed of the sheet metal brake.

11. In combination:

a sheet metal brake including a bending leaf having an upper edge surface, and an outer side surface, said upper edge surface and said outer side surfaces together forming a right angle outer corner;

hinge means at the ends of the bending leaf supporting the bending leaf for pivotal movement; and an attachment for said bending leaf, comprising:

a pair of spaced apart end mounts;

means connecting the end mounts to the sheet metal brake;

a frame extending longitudinally between said end mounts;

means pivotally connecting the frame to said end mounts, for pivotal movement between a start position and a forming position;

force applying surfaces means carried by said frame, wherein when the frame is in its start position and a sheet metal member is supported on the edge surface of the bending leaf, and extend horizontally outwardly beyond the outer side of the bending leaf, said force applying surface means makes contact with an upper surface portion of the sheet metal member at a location immediately outwardly of the right angle corner on the bending leaf; and said means for pivotally connecting comprising a pair of arcuate slots, one in each end mount, having centers substantially coinciding with said right angle corner, and bearing means carried by the frame and extending into said slots, said bearing means mounting the frame for pivotal movement between its start and bending positions about an axis coinciding with said right angle corner on the bending leaf.

12. The combination of claim 11, wherein the frame is spaced radially outwardly from said right angle corner on the bending leaf, and at least one tooth secured to said frame and extending therefrom generally towards the said right angle corner on the bending leaf, said force applying surface means comprising an end surface on said tooth.

13. The combination of claim 11, comprising an elongated bar member extending between said end mounts and at its ends being connected to said end mounts, said bar member being positionable on the bed of the sheet metal brake.

14. The combination of claim 11, comprising connection means secured to said end mounts, each said connection means including a member which projects laterally from its end mount contiguous the outer side of the bending leaf, and screw fastener means extendible through said member and connectable to the bending leaf, for connecting such member and the end mount of which it is a part to the bending leaf.

15. The combination of claim 14, comprising an elongated bar member extending between said end mounts and at its ends being connected to said end mounts.

* * * * *

UNITED STATES PATENT AND TRADEMARK OFFICE

CERTIFICATE OF CORRECTION

PATENT NO. : 4,713,957

DATED : December 22, 1987

INVENTOR(S) : Ernest J. Eder and Laverne D. Goodwin

It is certified that error appears in the above-identified patent and that said Letters Patent are hereby corrected as shown below:

In the Abstract, second line, "shet" should be -- sheet --.
In the Abstract, third line from the bottom, "togehter" should be -- together --.
Column 1, line 9, after "applied", insert -- to --.
Column 1, line 39, "attchment" should be -- attachment --.
Column 1, line 54, "the" should be -- The --.
Column 4, line 23, "attchment" should be -- attachment --.
Column 5, line 47, "surface 28" should be -- surface 38 --.
Claim 1, column 6, line 24, "position" should be -- portion --.
Claim 4, column 7, line 3, "of", second occurrence, should be -- to --.
Claim 10, column 8, line 11, "end" should be -- ends --. (1st occurrence)
Claim 11, column 8, line 32, "extend" should be --extends--.

Signed and Sealed this

Seventeenth Day of May, 1988

*Attest:*

*Attesting Officer*

DONALD J. QUIGG

*Commissioner of Patents and Trademarks*